US005640912A

United States Patent [19]

Diffrient

[11] Patent Number: 5,640,912

[45] **Date of Patent: *Jun. 24, 1997**

[54] FOLDABLE TABLE WITH DETACHABLE WIRE MANAGEMENT TRAY

[75] Inventor: Niels Diffrient, Ridgefield, Conn.

[73] Assignee: Howe Furniture Corporation, Trumbull, Conn.

[ * ] Notice: The term of this patent shall not extend beyond the expiration date of Pat. No. 5,337,657.

[21] Appl. No.: 378,521

[22] Filed: Jan. 26, 1995

[51] Int. Cl.[6] ..... A47B 35/00

[52] U.S. Cl. ..... 108/50; 108/23; 312/223.1; 312/223.6

[58] Field of Search ..... 312/223.1, 223.6; 108/50, 23; 211/88; 16/225, 227

[56] References Cited

U.S. PATENT DOCUMENTS

| | | | |
|---|---|---|---|
| 4,296,981 | 10/1981 | Hildebrandt et al. | 312/223.6 |
| 4,403,700 | 9/1983 | Manlove | 211/88 |
| 4,670,938 | 6/1987 | Fowlston | 16/225 |
| 4,687,094 | 8/1987 | Allsop et al. | 211/88 |
| 4,884,513 | 12/1989 | Newhouse et al. | 108/50 |
| 4,948,205 | 8/1990 | Kelley | 312/223.6 |
| 5,024,167 | 6/1991 | Hayward | 108/50 |
| 5,337,657 | 8/1994 | Diffrient | 108/50 |
| 5,429,431 | 7/1995 | Olsen et al. | 108/23 |

*Primary Examiner*—Peter M. Cuomo
*Assistant Examiner*—Anthony D. Barfield
*Attorney, Agent, or Firm*—Ware, Fressola, Van der Sluys & Adolphson LLP

[57] ABSTRACT

A combined wire manager and modesty panel for a folding gate leg table is detachably secured to the ends of the table beam. The modesty panel is formed by a cover which engages the wire manager tray by means of a novel clip arrangement which allows entry to the tray without the need for completely removing the panel.

13 Claims, 2 Drawing Sheets

FOLDABLE TABLE WITH DETACHABLE WIRE MANAGEMENT TRAY

TECHNICAL FIELD

This invention relates to the field of folding tables. More specifically, it pertains to the a management tray which may be detachably connected to such a table.

BACKGROUND ART

Foldable tables for use in industrial and commercial applications are well known. One type of such table is the gate leg table which has been adapted for computer use by the addition of various wire managers and galleries for concealing the clutter of computer cables. A gate leg table comprises a horizontal beam having hingedly mounted to each end one of a pair of leg assemblies which are adapted to fold inwardly for storage. A table top is hingedly secured along the length of the beam. When the table is erected, the top is supported by the leg assemblies. When folded, it lies along the beam. An example of a table of this type is disclosed and illustrated in U.S. Pat. No. 5,337,657 issued Aug. 16, 1994 to Niels Diffrient. The disclosure of that patent is incorporated by reference herein. In the table described in such patent, a wire manager is connected to the beam by being hooked over the top of the beam and includes a cover which is mounted by a piano hinge.

DISCLOSURE OF INVENTION

The present invention provides an alternative solution to the problem of wire management on a folding gate leg table. In accordance with the present invention, a wire management tray is removably mounted to the ends of the table beam where it may be easily removed, if desired, when the table is stored. In addition, there is provided a cover which is removable from the tray but can also be left in a half open position, providing access to the wire tray. The cover, when closed, leaves a gap at the top permitting entry of wires and the assembly also serves as a modesty panel.

BEST MODE FOR CARRYING OUT THE INVENTION

Figure 1:
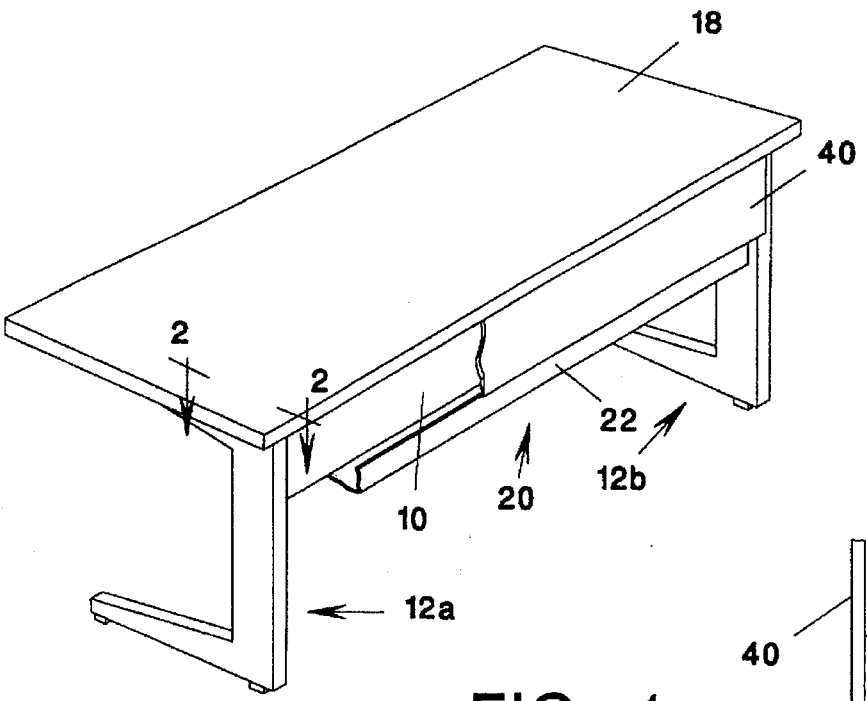
FIG. 1 is a perspective view of a table in accordance with the invention with a portion of the wire tray and panel broken away to illustrate the internal construction.
Figure 2:
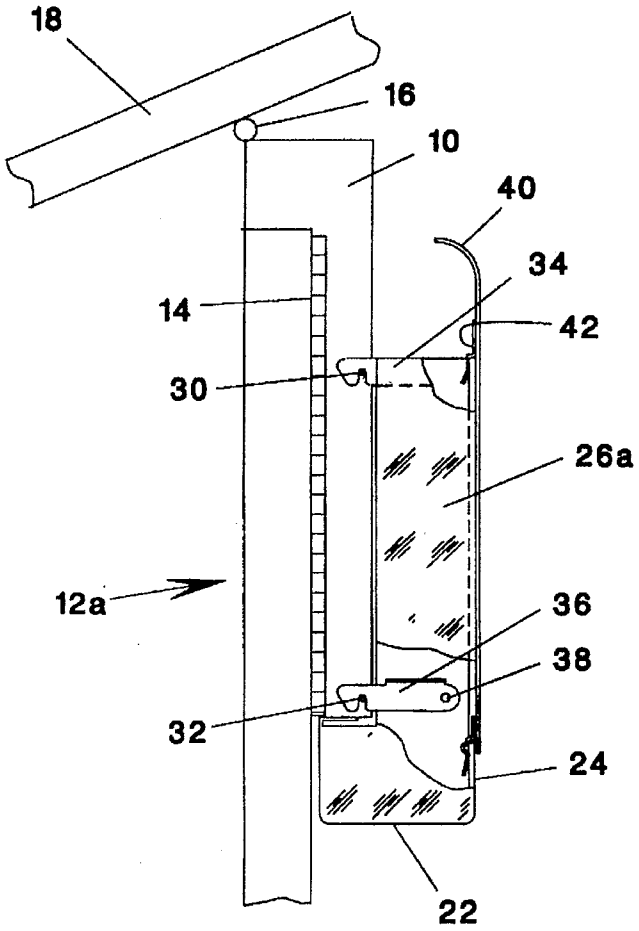
FIG. 2 is an enlarged cross-section taken substantially along the plane 2—2 with the table in its partially folded condition.

With particular reference to FIG. 1, there is illustrated a folding gate leg table comprising a horizontal beam 10. Hingedly secured to each end of the beam is a C-shaped leg assembly 12*a*, 12*b*. Each leg assembly is secured to the beam end by means of a piano hinge 14. This construction is clearly illustrated in FIG. 2 wherein the leg assembly 12*a* is illustrated as being folded against the beam 10. Running the length of the beam 10 is one or more piano hinges 16 to which is mounted a table top 18. As illustrated in FIG. 2, the table top 18 is shown in a partially folded condition.

Figure 3:
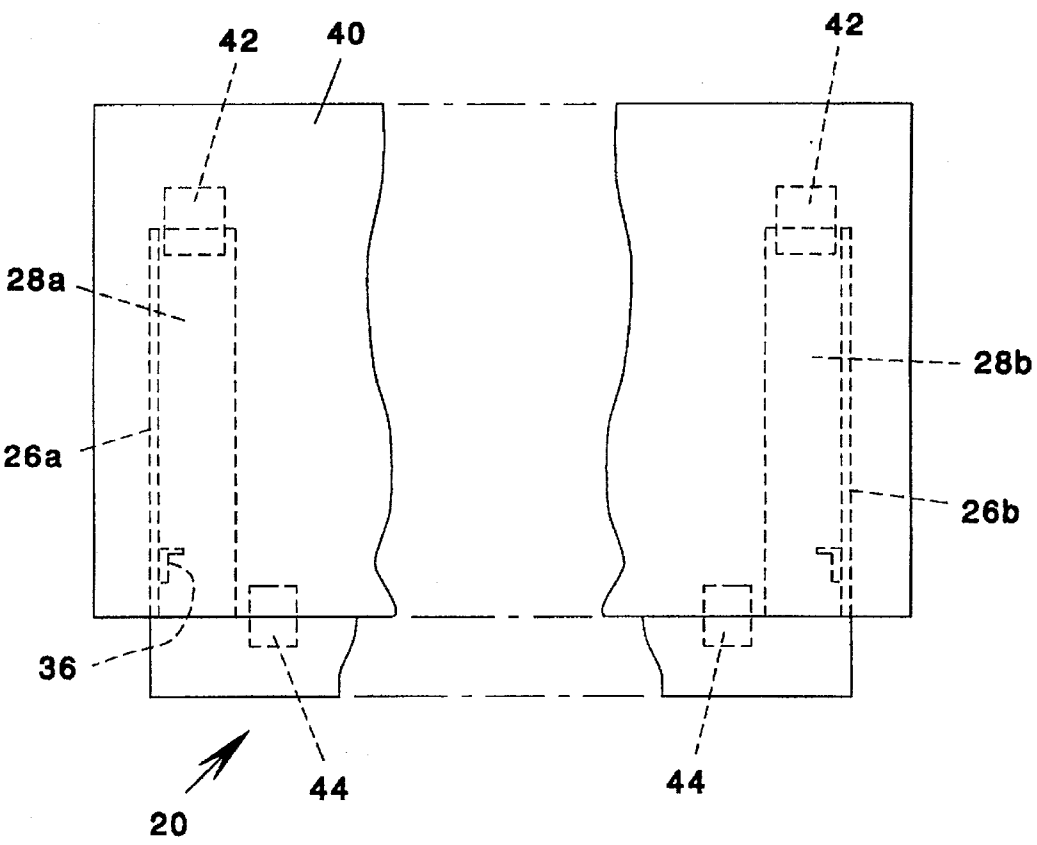
FIG. 3 is an elevational view of the panel and wire tray of FIG. 2.

In order to adapt the table of FIG. 1 for use with computer components, there is provided a detachable wire tray 20. The tray assembly 20 is essentially U-shaped and includes a horizontal tray 22 which is substantially rectangular in cross-section and bounded along its length by a vertical edge wall 24. The ends of the tray 22 are closed by side panels 26*a*, *b* which extend upwardly from the tray 22 as illustrated in FIGS. 2 and 3 thereby forming a generally U-shaped member together with front wall portions 28*a*, 28*b* which extend upwardly as extensions of the edge wall 24 of tray 22. An upper pin 30 and a lower pin 32 extend into each end of the beam 10. The wire tray assembly 20 is hung onto these pins by four hooks. Each of the side panels 26*a*, *b* carries an integral upper hook 34 which extends from the side panel 26 to engage the upper pin 30. Each side panel also carries a lower latching hook 36 which is rotatable about a pivot 38 to releasably engage the lower pin 32. With this construction, the wire tray assembly may be easily removed from the beam 10 and nothing remains on the beam to interfere with the table being folded and stacked.

Figure 5:
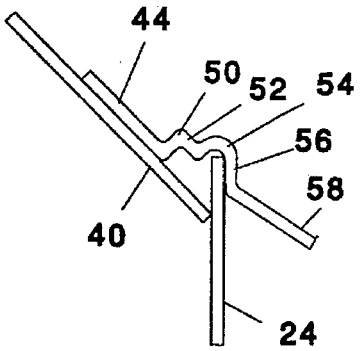
FIG. 5 is an illustration of the operation of one of the novel clips of the invention.
Figure 4:
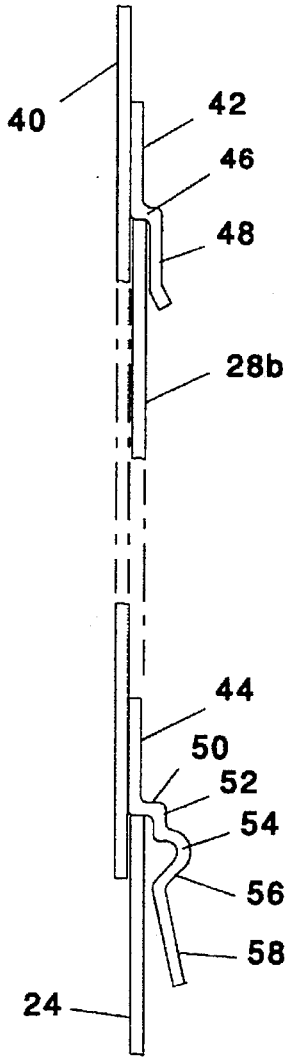
FIG. 4 is an enlarged illustration showing the manner in which clips retain the panel on the wire tray.

In order to close the wire tray assembly 20, there is provided a panel 40. The panel 40 hooks onto the wire tray assembly by means of a pair of upper clips 42 and lower clips 44. The upper clips 42 are essentially Z-shaped, as is illustrated more clearly in FIG. 4. Each of the upper clips 42 includes an offset portion 46 and a depending tab 48 which engages the upper edge of its corresponding front wall portion 28*a*, 28*b*. The lower clips 44 are positioned so as to engage the edgewall 24 of the tray 22. If the lower clips 44 were identical to the upper clips 42, it would then be necessary to completely remove the panel 40 and lay it aside in order to work within the wire tray. This has been avoided, however, by means of the novel construction of the lower clips 44 as illustrated in FIGS. 4 and 5. Each of the lower clips 44 includes an offset portion 50 which engages the upper edge of the edgewall 24 in essentially the same manner as the upper clip 42 as shown in FIG. 4. However, the resulting spaced tab 52 does not depend directly parallel to the plane of the panel 40. Rather, it is bent further to provide a second offset portion 54 which terminates in a tab 56. The tab 56 lies in a plane which is at substantially a 45° angle to the plane of panel 40 and terminates in a slightly angled guide tab 58.

The user wishing to gain access to the wire tray merely lifts the panel 40 sufficiently to disengage the upper clips from the front wall portions 28*a*, *b*. The panel 40 may then be laid back to the position illustrated in FIG. 5, wherein the edge of the edge wall 24 supports the second offset portion 54 and its tab 56, while the bottom edge of the panel 40 rests against the edge wall 24 of the tray as illustrated in FIG. 5. By means of this novel construction, the need for completely removing the panel 40 is avoided and the panel is easily raised back into the full closed position of FIG. 4 when desired. It will also be noted from FIG. 2 that the upper edge of the panel 40 is curved slightly inward for aesthetic reasons but remains open for limited access whereby cables and wires may be dropped into the open space.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

I claim:

1. In a table including a beam having a longitudinal supporting edge and first and second ends, a first leg assembly hingedly connected to the first end of said beam, a second leg assembly hingedly connected to the second end of said beam, and a top hingedly connected to the supporting edge of said beam for movement between a working position supported by said leg assemblies and a folded position, the improvement which comprises:

a U-shaped wire manager tray assembly having a first side panel including means for releasably connecting to the first end of said beam, a second side panel including means for releasably connecting to the second end of said beam, and an open elongated intermediate wire tray interconnecting the first and second side panels; and a back panel including means for releasably connecting to said tray assembly and having a bottom edge adjacent said wire tray to conceal the contents of said wire tray and function as a modesty panel for said table.

2. The wire manager and modesty panel of claim 1 wherein the connecting means of each of said first and second side panels includes hook means for engaging a respective first or second end of said beam.

3. The wire manager and modesty panel of claim 2 wherein the first hook means of each side panel is fixed relative to said side panel and the second hook means is rotatable relative to said side panel.

4. In a table including a beam having a longitudinal supporting edge and first and second ends, a first leg assembly hingedly connected to the first end of said beam, a second leg assembly hingedly connected to the second end of said beam, and a top hingedly connected to the supporting edge of said beam for movement between a working position supported by said leg assemblies and a folded position, the improvement which comprises:

a U-shaped wire manager tray assembly having a first side panel including means for releasably connecting to the first end of said beam, a second side panel including means for releasably connecting to the second end of said beam, an open elongated intermediate wire tray interconnecting the first and second side panels, said wire tray having an edge wall with extensions in the form of first and second front wall portions adjacent the respective first and second side panels; and a back panel including means for releasably connecting to said tray assembly and having a bottom edge adjacent said wire tray to conceal the contents of said wire tray and function as a modesty panel for said table.

5. The wire manager and modesty panel of claim 4 wherein the connecting means of said back panel includes first and second clips spaced to engage the respective first and second front wall portions of said U-shaped tray assembly and suspend the back panel therefrom in a closed position.

6. The wire manager and modesty panel of claim 5 wherein said back panel includes a third clip engageable with said elongated intermediate wire tray.

7. The wire manager and modesty panel of claim 6 wherein said back panel includes a fourth clip engageable with said elongated intermediate wire tray.

8. The wire manager and modesty panel of claim 7 wherein said wire tray includes an elongated edge intermediate said first and second side panels engageable with said third and fourth clips.

9. The wire manager and modesty panel of claim 8 wherein each of said third and fourth clips comprises:

a substantially planar body secured to said back panel;

a first offset portion substantially parallel to, and spaced from, said back panel to receive the elongated edge of said wire tray therebetween.

10. The wire manager and modesty panel of claim 9 wherein each of said third and fourth clips is positioned adjacent the bottom edge of said back panel and additionally comprises:

a second offset portion spaced from, and forming an acute angle with, said back panel to receive the elongated edge of said wire tray therebetween and to support said back panel in an open position substantially at said acute angle relative to its closed position when said first and second clips are disengaged from said first and second front wall portions.

11. The wire manager and modesty panel of claim 10 wherein each of said first and second side panels includes hook means for engaging a respective first or second end of said beam.

12. The wire manager and modesty panel of claim 11 wherein each of said first and second side panels includes first and second hook means.

13. The wire manager and modesty panel of claim 12 wherein the first hook means of each side panel is fixed relative to said side panel and the second hook means is rotatable relative to said side panel.

* * * * *